US007546794B1

(12) United States Patent
Sarles et al.

(10) Patent No.: US 7,546,794 B1
(45) Date of Patent: Jun. 16, 2009

(54) ADJUSTABLE MULTI-CALIBER, MULTI-FEED AMMUNITION CONTAINER

(75) Inventors: J. Stephen Sarles, Lake in the Hills, IL (US); Daniel R. Landwehr, Hampshire, IL (US); Leslie E. Erickson, Crystal Lake, IL (US)

(73) Assignee: Recon/Optical, Inc., Barrington, IL (US)

( * ) Notice: Subject to any disclaimer, the term of this patent is extended or adjusted under 35 U.S.C. 154(b) by 340 days.

(21) Appl. No.: 11/522,133

(22) Filed: Sep. 14, 2006

(51) Int. Cl.
*F41A 9/61* (2006.01)

(52) U.S. Cl. ..... 89/34; 206/3

(58) Field of Classification Search ..... 89/34, 89/33.14, 33.16, 33.1, 1.1; 42/49.02, 50; 206/3

See application file for complete search history.

(56) References Cited

U.S. PATENT DOCUMENTS

| | | | | |
|---|---|---|---|---|
| 4,009,638 | A | 3/1977 | Ramseyer et al. | 89/34 |
| 4,445,419 | A | 5/1984 | Fischer | 89/33 |
| 4,610,191 | A | 9/1986 | Schmid et al. | 89/34 |
| 4,942,991 | A | 7/1990 | Lyons | 224/196 |
| 4,972,758 | A | 11/1990 | Austin et al. | 89/34 |
| 4,974,490 | A * | 12/1990 | Austin | 89/34 |
| 5,949,015 | A | 9/1999 | Smith et al. | 89/41.05 |
| 6,164,180 | A | 12/2000 | Sulm et al. | 89/33.16 |
| 6,439,098 | B1 * | 8/2002 | Dillon | 89/34 |
| 6,769,347 | B1 | 8/2004 | Quinn | 89/41.05 |

OTHER PUBLICATIONS

Search Report and Written Opinion in PCT/US2007/015535, dated Jul. 31, 2008.

* cited by examiner

*Primary Examiner*—Michael Carone
*Assistant Examiner*—Jonathan C Weber
(74) *Attorney, Agent, or Firm*—McDonnell Boehnen Hulbert & Berghoff LLP

(57) ABSTRACT

An ammunition container is in the form of an enclosure for holding a supply of ammunition, preferably in belt form. A partition member is positioned in the enclosure. The container includes three separate holding features positioned in a spaced-apart relation relative to the enclosure which are adapted to engage the partition. The holding features and partition thereby provide a capability of holding ammunition of at least three different calibers.

24 Claims, 8 Drawing Sheets

ADJUSTABLE MULTI-CALIBER, MULTI-FEED AMMUNITION CONTAINER

STATEMENT REGARDING FEDERALLY SPONSORED RESEARCH OR DEVELOPMENT

Not applicable.

BACKGROUND OF THE INVENTION

A. Field of the Invention

This invention relates generally to the field of ammunition containers and more particularly an ammunition container capable of stowing and supplying ammunition rounds of three or more different calibers. The invention also relates to a cover for an ammunition container which facilitates feed of different caliber rounds.

B. Description of Related Art

Weapon mounts have been developed which are capable of fitting different types of guns in order to fire a variety of different types of rounds, such as .50 cal. bullets, 40 mm grenades, and 5.56 and 7.62 machine gun rounds. Some of these weapon mounts are remotely operated, and some, but not necessarily all, of such remotely operated weapon mounts are stabilized. See, for example, U.S. Pat. Nos. 6,769,347 and 5,949,015, the content of which his incorporated by reference herein. These weapon mounts typically utilize an ammunition storage container to stow and protect the rounds for the gun as a well as to allow the rounds to feed smoothly to the gun during operation. Such rounds are in a belt format, with successive rounds placed in the belt and oriented transverse to the length of the belt.

When the gun type is changed over in order to fire a different type of round, the ammunition container must also be changed to accommodate the new caliber ammunition and required ammunition feed system. Prior art of interest includes the following U.S. Pat. Nos. 6,164,180; 4,972,758; 4,942,991; 4,610,191; 4,445,419, and 4,009,638.

When the gunner desires to change the type of round and the gun, it is desirable that the gunner be able to re-configure an ammunition container to properly stow the new ammunition quickly, without tools and in a simple a manner as possible, rather than replace the container. This invention meets a need in the art for an ammunition container which can be quickly and simply reconfigured to hold and feed at least three and preferably four (or more) different sizes or calibers of rounds, without tools.

Furthermore, it is desirable that the ammunition container contain a minimum number of rounds, such as at least 200 rounds of .50 cal. ammunition, at least 96 rounds of 40 mm ammunition, and at least 400 rounds of 5.56 mm and 7.62 mm ammunition. It is desirable that the ammunition container accommodate all four types of rounds, and store at least the minimum number of required rounds, with a minimum of reconfiguration. This invention meets these needs as well.

SUMMARY OF THE INVENTION

In a first aspect, an ammunition container is disclosed in the form of an enclosure for holding a supply of belted ammunition and having a partition member positioned in the enclosure. The container includes three separate holding features, such as pairs of slots, positioned in a spaced-apart relation relative to the enclosure, which engage the partition. The holding features and the partition thereby provide the ammunition container with a capability of holding ammunition of at least three different calibers. When the partition is moved such that it is held or engaged by the first holding feature, a belt holding ammunition of a first caliber (e.g., 5.56 mm or 7.62 mm) is placed in the container and stowed in a secure manner whereby it will feed from the container to a gun. When the partition is engaged by the second holding feature, a belt holding ammunition of a second caliber (e.g., 40 mm grenade) can be stowed in the container whereby it will properly feed to a second gun associated with the second caliber. When the partition is engaged in the third pair of holding features, a belt holding ammunition of a third caliber (e.g., .50 cal.) can be securely stowed in the container.

The gunner's task of reconfiguring the ammunition container for handling different rounds is very simple. He/she simply disengages the partition from the holding feature and repositions it such that it engages the holding feature that corresponds to the new size round. For small caliber rounds, a self-storing transverse partition member is placed in the enclosure to facilitate holding multiple layers of a belt holding small caliber rounds without sagging in the middle, which may hinder feeding of the belted ammunition particularly during vehicle operation. Further, for the smaller caliber rounds, the belt of ammunition can be placed and held on both sides of the main partition thereby increasing the number of rounds that can be held by the container.

In one representative embodiment, the ammunition container is designed for use with a remotely operated weapon mount. Such mount may be affixed to a variety of ground vehicles or marine applications, e.g. patrol boat. The mount may also be a stabilized weapon mount.

A second aspect of this disclosure is directed to a cover for an ammunition container that accommodates at least two different types (caliber) of rounds. The cover is placed over the ammunition container and may be left in place while the container is in use with the associated weapon. The cover has a first mechanism for feeding a belt with relatively smaller caliber rounds (such as 7.62 mm or 5.56 mm). It also includes a separate aperture through which a belt of relatively larger caliber rounds (e.g., 40 mm or .50 cal.) may be supplied from the ammunition container. The cover further includes a lid for the aperture. When the smaller caliber rounds are placed in the container, the lid is placed over the aperture.

In yet another aspect, a method is provided of reconfiguring an ammunition container having a region for stowing ammunition of a first caliber, a second caliber and a third caliber, comprising the steps of: positioning a partition within the region of the ammunition container for receiving ammunition, the partition placed in a first position wherein the ammunition of the first caliber is stowed between the partition and a first wall of the container; positioning the partition in a second position when ammunition of the second caliber is to be stowed in the container, the ammunition of the second caliber stowed between the partition and the first wall of the container; and positioning the partition in a third position when ammunition of the third caliber is to be stowed in the container, the ammunition of the third caliber stowed between the partition and the first wall of the container.

These and other aspects of the inventive ammunition container will be explained in greater detail in the following description and with reference to the appended drawing figures.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

DETAILED DESCRIPTION

Figure 1:
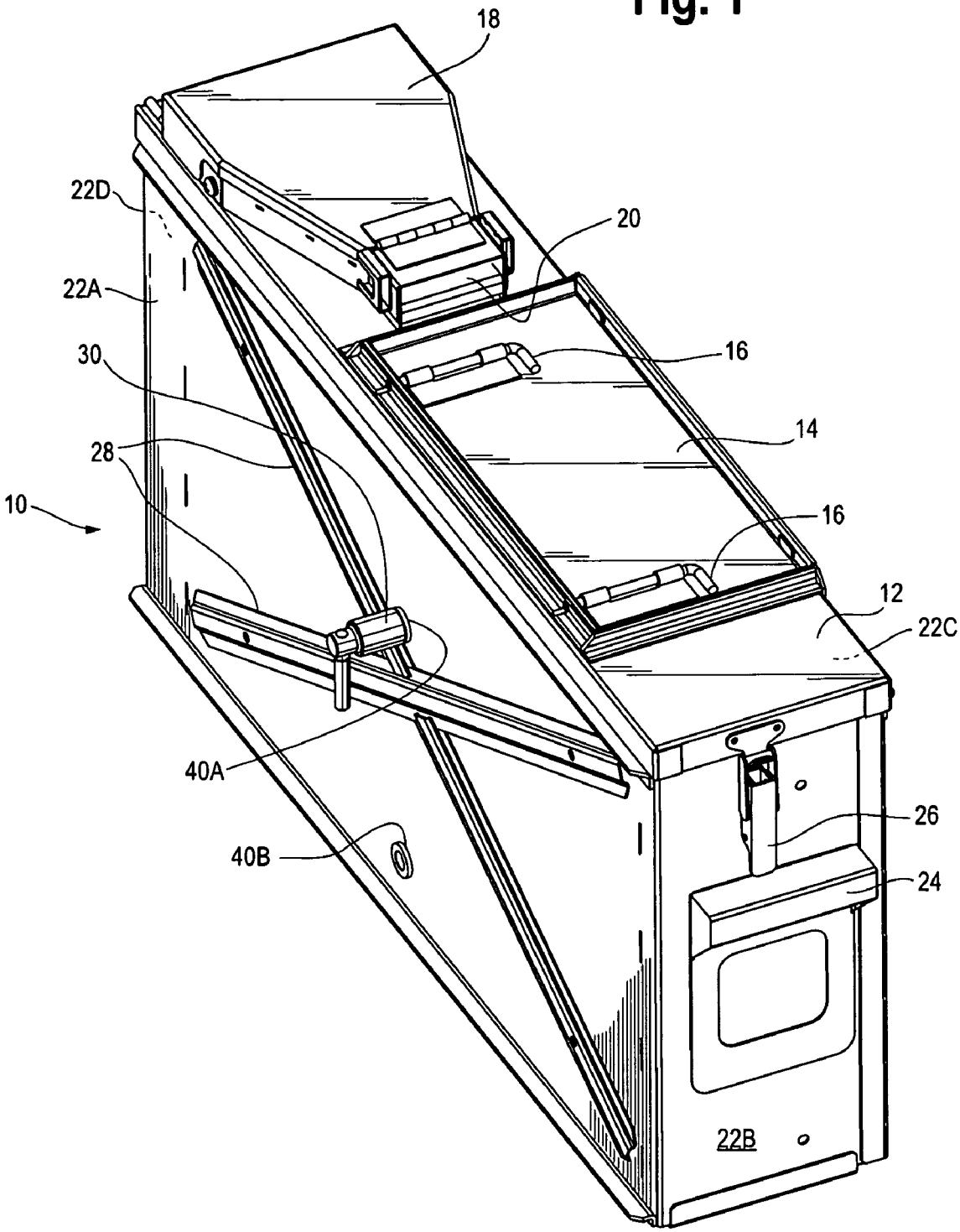
FIG. 1 is a perspective view of an ammunition container in accordance with a presently preferred embodiment of the invention, with the cover for the container in place.
Figure 2:
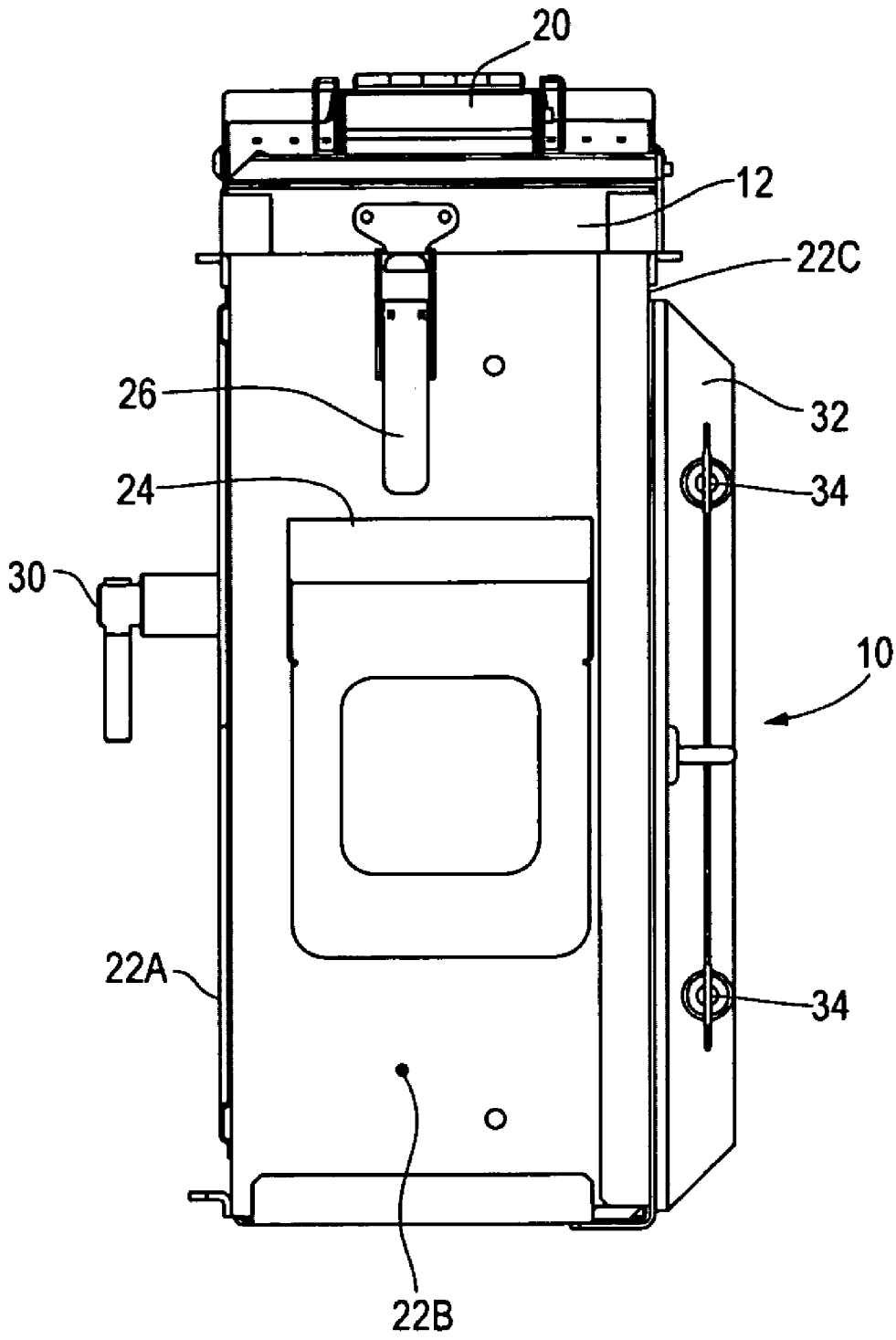
FIG. 2 is an end view of the container of FIG. 1.

An ammunition container 10 for a weapon in accordance with a preferred embodiment of this invention is shown in FIG. 1 in a perspective view. The container includes partition features, best shown in FIGS. 5-9, which allow the container to be quickly and easily reconfigured to hold ammunition of at least three different calibers. The illustrated embodiment provides the ability to hold ammunition of four different calibers, namely 5.56 mm, 7.62 mm, 40 mm and .50 cal rounds (all in belt configuration). The gunner can quickly configure the ammunition container to hold such ammunition by moving the position of a partition member within the container 10. Such action can be done without the use of tools. The gunner does not need to change out the ammunition container when changing the type of gun. Rather, the container remains attached to the weapon (or its mount), the old ammunition is removed, the container is reconfigured to receive the new ammunition, the new ammunition is loaded into the container and fed to the new gun, which is then ready for action. The ammunition container further includes features which allow a cover to be in place over the ammunition container during use of the gun, the cover providing a facility to feed the ammunition from the container to the associated gun and also keep dirt and foreign objects from entering the ammunition container.

The illustrated embodiment was designed for a stabilized, remotely-operated weapon mount sold under the trademark SRWS® of the assignee Recon/Optical. Associated weapon cradles allow different guns to be affixed to the mount to enable the firing a variety of rounds, including .50 caliber rounds, 40 mm grenades, and 5.56 and 7.62 mm machine gun rounds. The principles of the invention are applicable to other types of weapon mounts, including, of course, functionally similar mounts to the SRWS® mount or variations thereof, and other types of rounds. The explanation of the preferred embodiment provided herein, and the application to a stabilized, remotely operated weapon mount, and to particular caliber and type of rounds is offered by way of example and not limitation. The ammunition container can be of course used for other types of mounts and other types and calibers of rounds. All questions concerning scope of the invention are to be answered by reference to the appended claims.

FIGS. 1-4 show perspective and side views of the container 10. The ammunition container 10 includes a cover 12 for an enclosure defined by a first pairs of opposed walls 22A and 22C and a second pair of opposed walls 22B and 22D. The cover 12 includes a removable lid or cover 14 for an opening through which larger caliber rounds are removed from the container 10 and supplied to a gun. The lid 14 is held to the cover 12 by means of spring-loaded pins 16. A flap 18 covers a feed roller 82 (FIG. 11) which provides a mechanism for supplying smaller caliber rounds through an aperture 20 to a feed chute (not shown) which supplies the smaller caliber rounds to an associated gun. Flap 18 is hinged and held to the cover 12 by a spring loaded latch pin 17. When smaller caliber rounds such as 5.56 mm or 7.62 mm are stored in the container 10, the lid 14 is in place as shown in FIG. 1 and the belt holding the smaller rounds exits the container 10 via aperture 20. When larger caliber rounds such as 40 mm or .50 rounds are stored in the container, the lid 14 is removed and the rounds feed through the aperture 80 (FIG. 10) to the gun.

Figure 6:
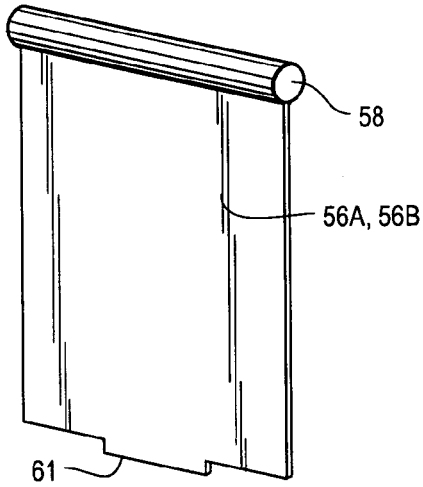
FIG. 6 is a perspective view of a transverse partition member, two of which are used when smaller caliber rounds are placed in the container in order to stow the ammunition belts without sagging in the middle of the container.
Figure 7:
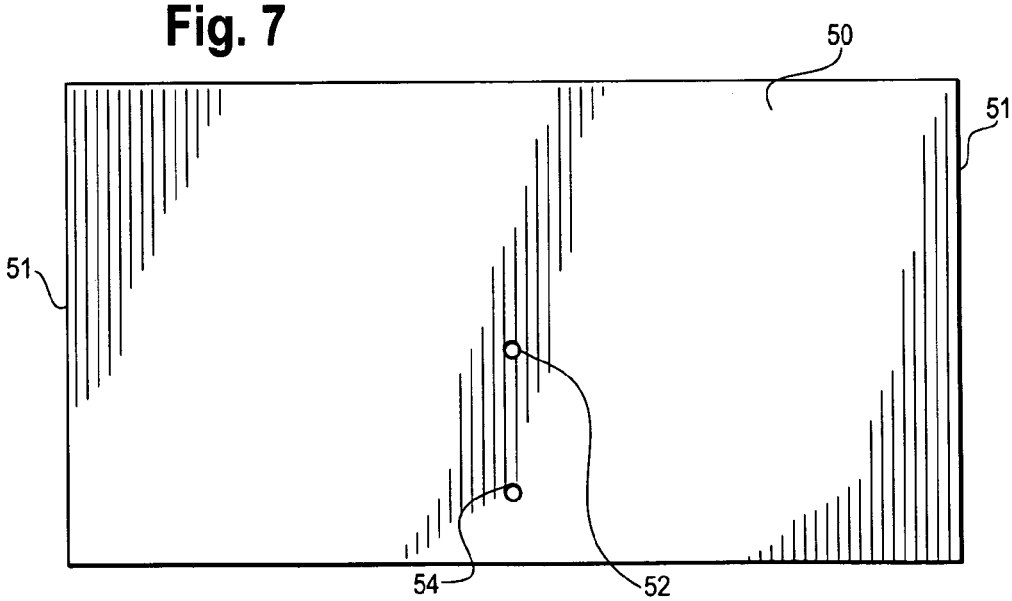
FIG. 7 is a side view of the main partition member shown in FIG. 5.
Figure 8:
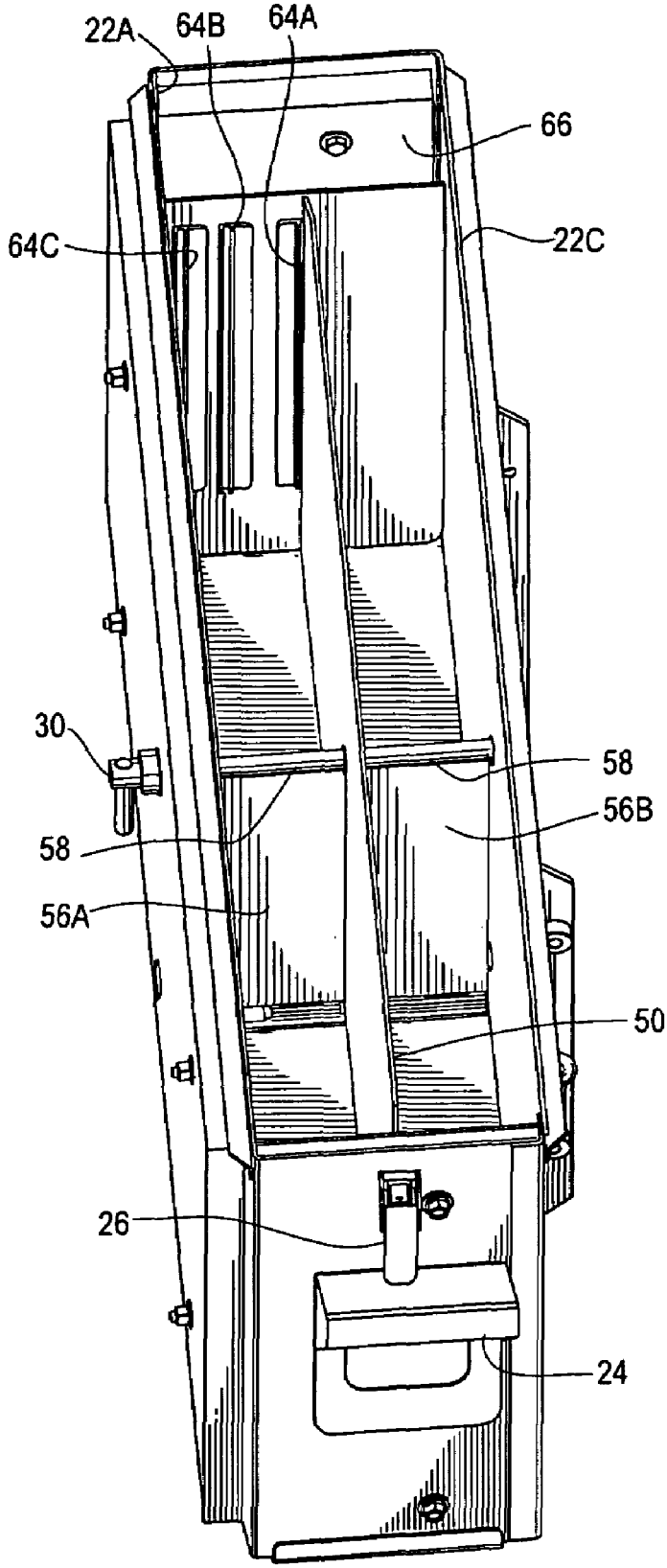
FIG. 8 is a perspective view of the container of FIG. 1, with the cover removed, with the main partition member in the position shown in FIG. 5.

The container 10 includes a pin 30 (FIG. 1) which extends transversely through the container 10, passing through the partition member 50 (see FIG. 8). There are two locations or elevations 40A and 40B (FIGS. 1, 3) through which the pin 30 may be positioned relative to the container 10 and partition member 50. In the upper position 40A, the pin 30 is used to hold transverse partition members 56A and 56B (FIGS. 6 and 8). The transverse partition members 56A and 56B include a tubular top position having an internal passage through which the pin 30 passes. The transverse partition members 56A, 56B support the smaller ammunition belt in the middle of the container to prevent excessive sag in the belt in the middle of container, helping the ammunition belt lay more flat and feed more reliably through the feed mechanism 82/18/20 in the cover 12.

Figure 5:
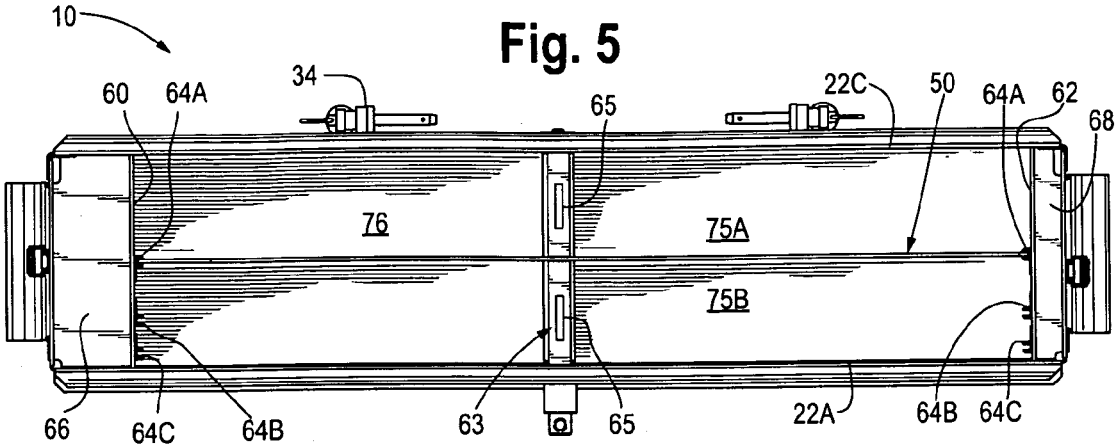
FIG. 5 is a top view of the container of FIG. 1, with the cover removed, showing a partition member placed in the container and held by holding features in the container in a position such that smaller caliber rounds such as 5.56 mm or 7.62 mm rounds can be placed in the container on both sides of the partition.
Figure 9:
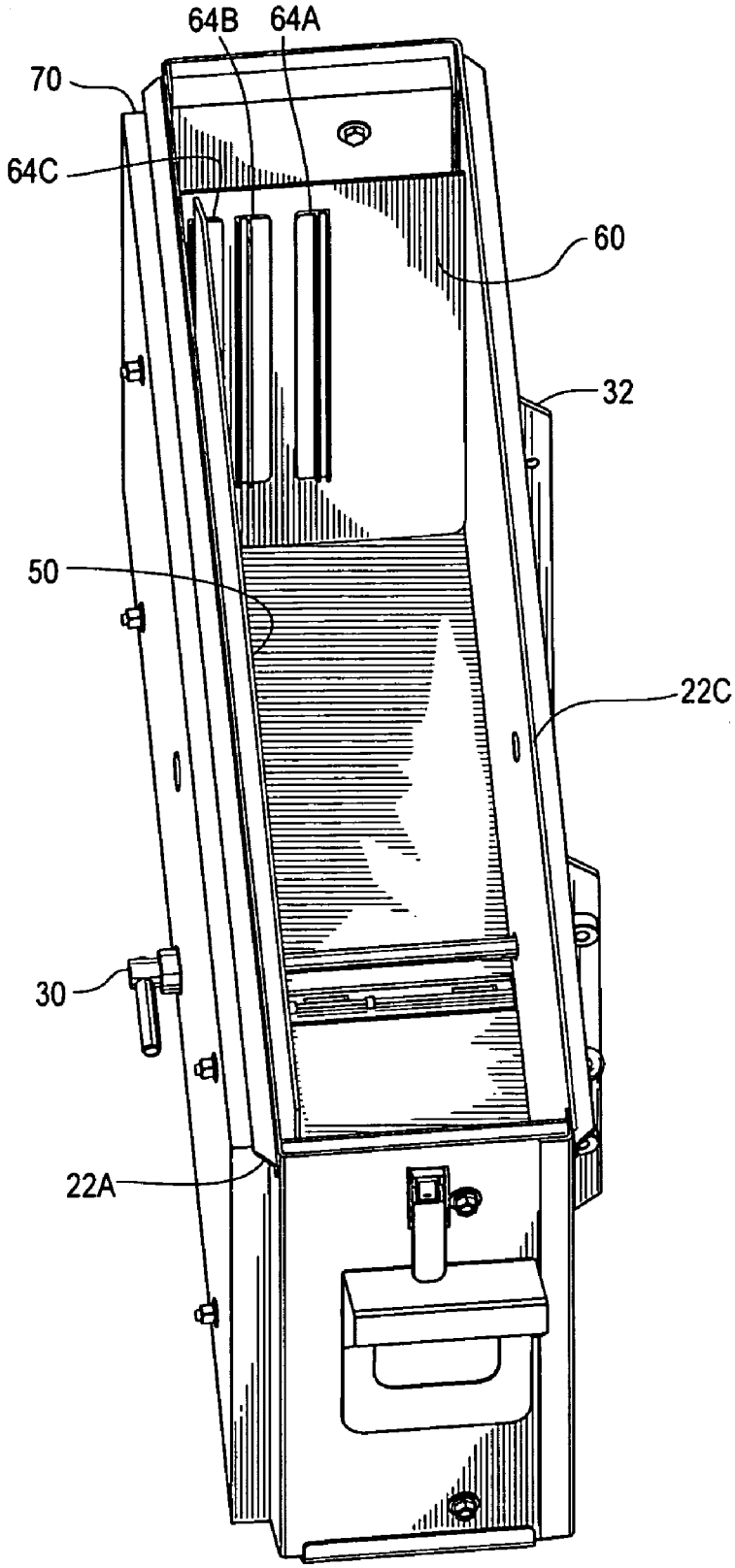
FIG. 9 is a perspective view of the container of FIG. 1 with the cover and partition member placed in a position for receiving .50 caliber ammunition.

When larger caliber ammunition such as 40 mm or .50 cal. rounds are stored in the container, the transverse partitions 56A and 56B are removed and stowed in a side chamber 66 (FIG. 5). The pin 30 is placed in the lower position 40B when larger caliber ammunition is stowed in the ammunition container 10, as best shown in FIG. 9.

Figure 11:
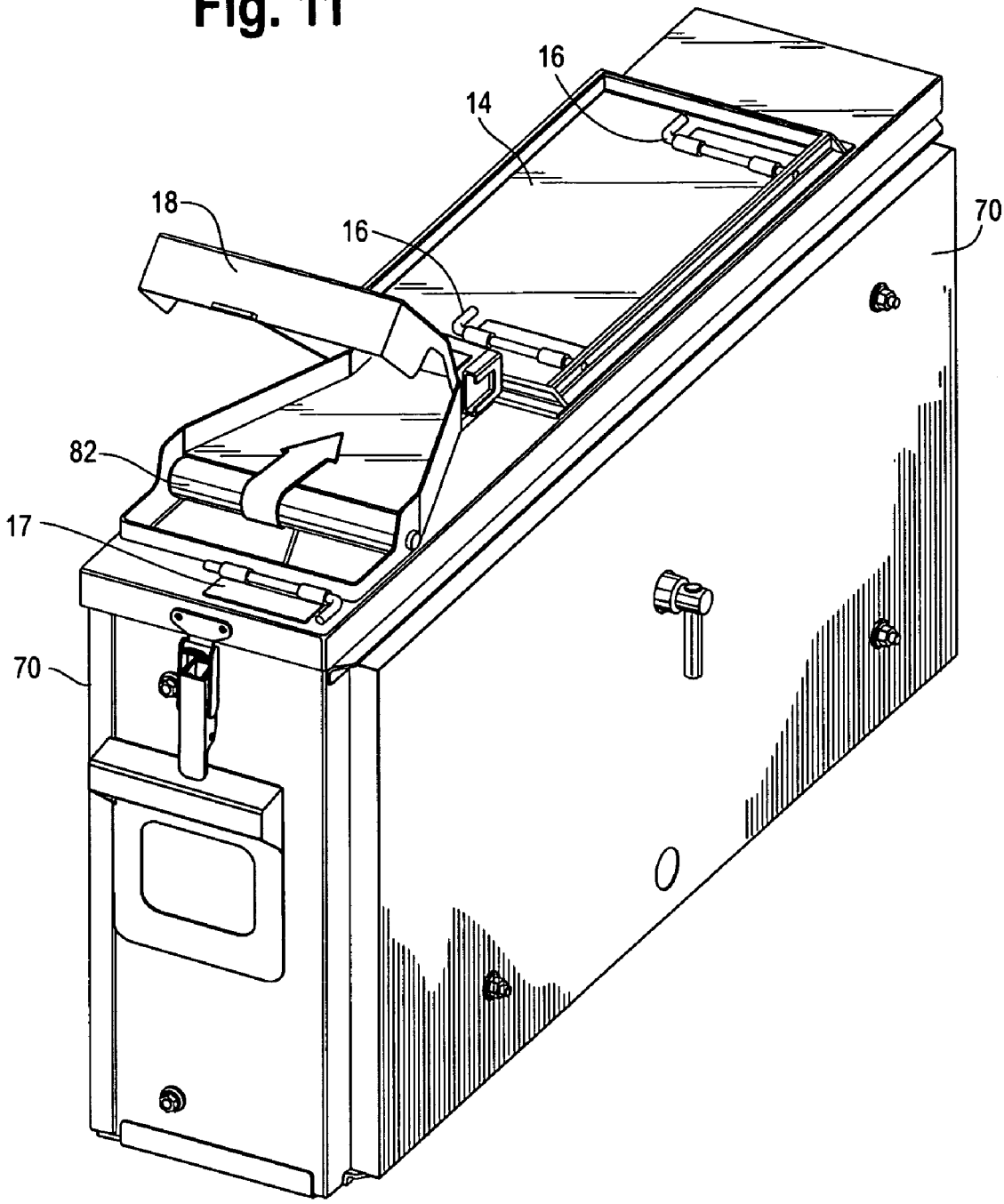
FIG. 11 shows another perspective view of the container of FIG. 1, with aperture of FIG. 10 covered, and showing a feed mechanism for feeding smaller caliber ammunition from the container to a gun.

The side walls 22A, 22B, 22C and 22D of the ammunition container may be made of suitable material such as steel, aluminum, composite material, etc. Stiffening members 28 (FIG. 1) and 35 (FIG. 4) may be attached to the walls 22A and 22C, respectively. The container further includes lifting handles 24 and latches 26 for securing the cover 12. A ballistics protection plate 70 is applied to the exterior of the wall 22A as shown in FIG. 11 to protect the ammunition from hostile fire. Ballistics protection plates are placed in the end slot 68 (FIG. 5) and in the region 66.

Figure 3:
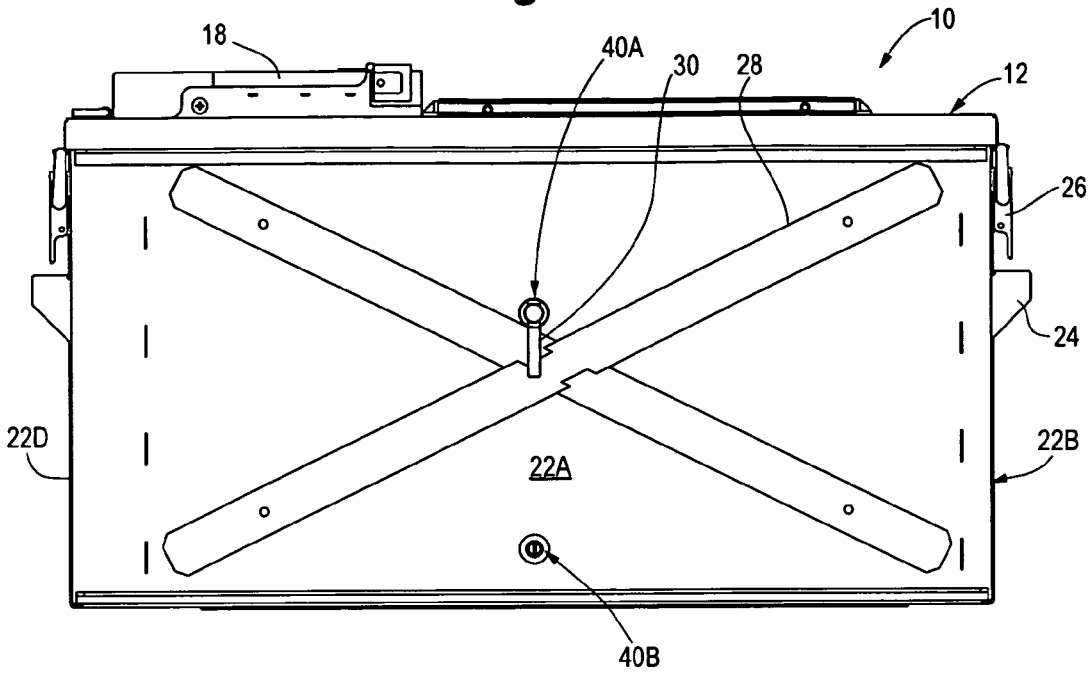
FIG. 3 is a side view of the container of FIG. 1.
Figure 4:
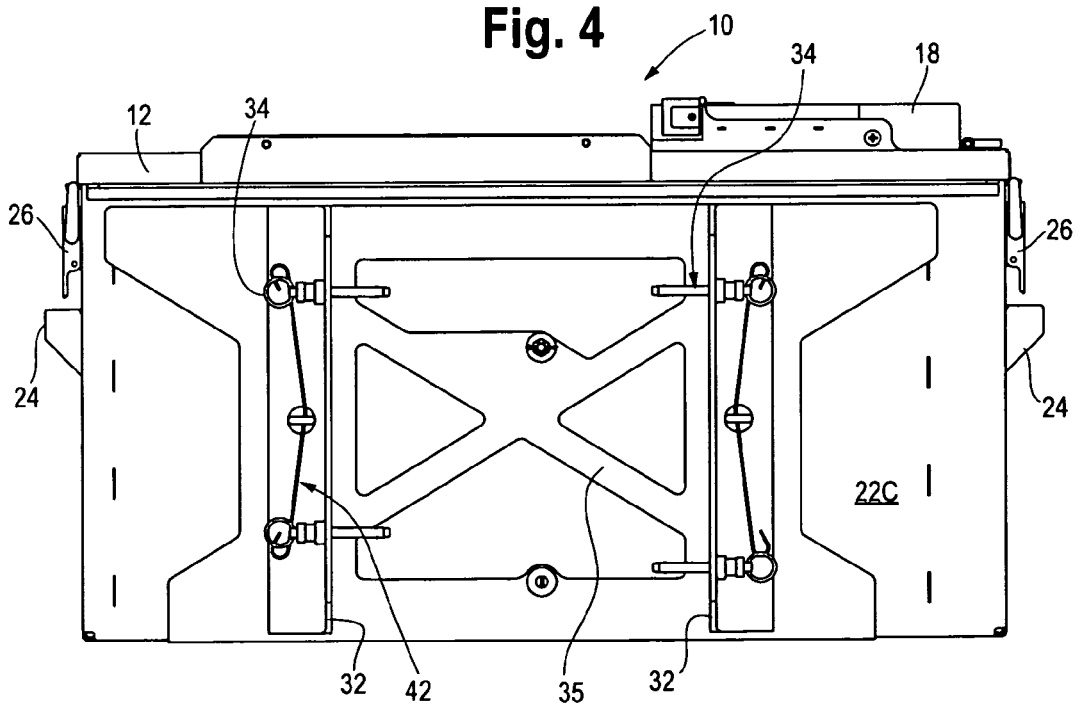
FIG. 4 is an opposite side view of the container of FIG. 1.
Figure 10:
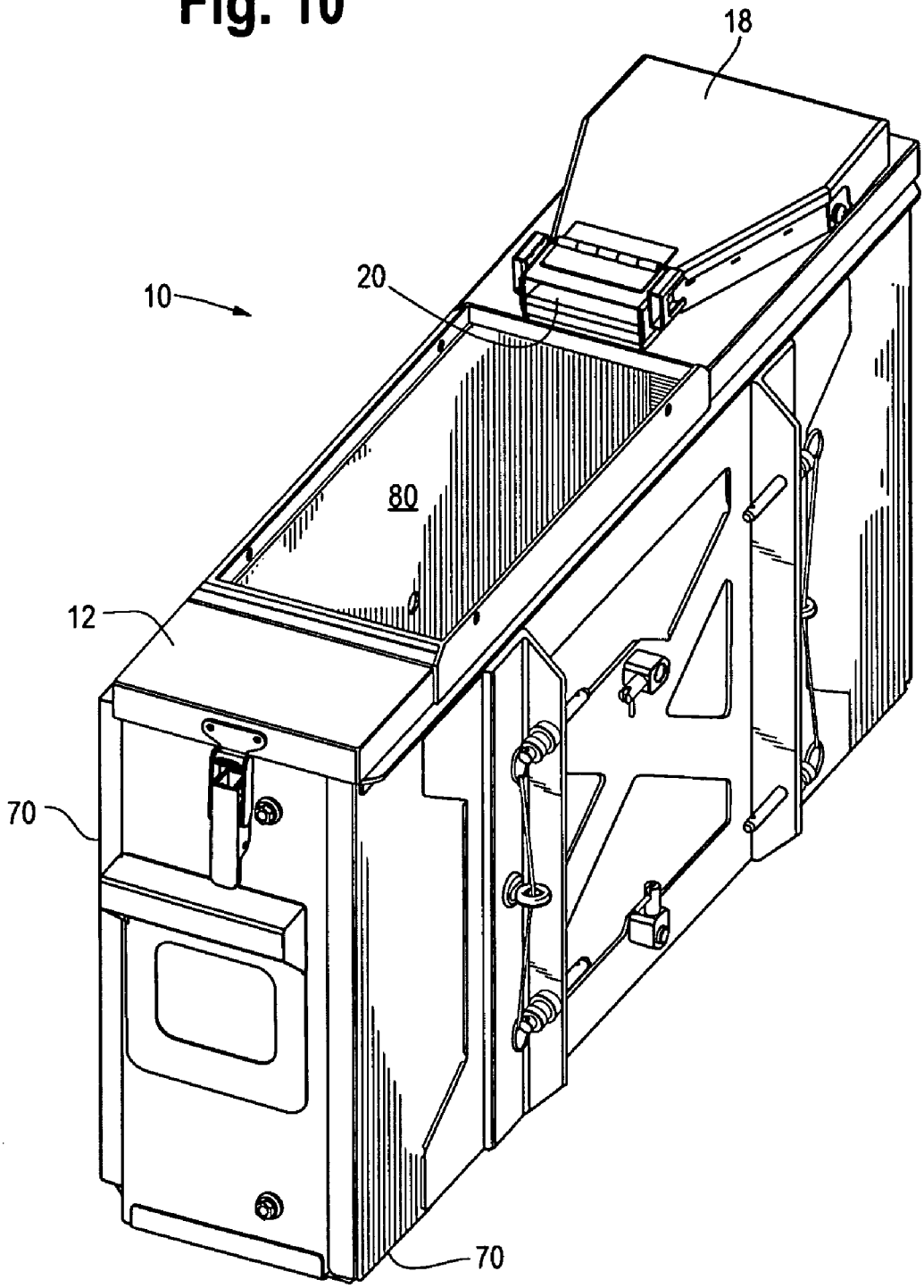
FIG. 10 is a perspective view of the container of FIG. 1 showing an aperture in the cover through which larger caliber ammunition is supplied from the container to a gun.

With reference to FIGS. 3-5, mounting flanges 32 are positioned on the wall 22C for mounting of the container 10 to the weapon mount (not shown) using quick release pins 34. Keepers 42 are attached to the heads of the pins as shown in FIGS. 4 and 10.

FIG. 5 is a top view of the container 10 of FIG. 1, with the cover 12 removed, showing a partition member 50 placed in the container 10. The partition member 50 (see also FIG. 7) takes the form of a flat, thin, plate-like divider extending substantially the full height of the interior of the container 50 (see FIGS. 7, 8, 9) and with opposite edges 51. The partition 50 can be lifted out of and inserted into the container 10 so as to configure the container to stow multiple different size rounds. The container 10 includes interior side walls 60 and 62, which include pairs of vertically-oriented slot features 64A, 64B and 64C for receiving the edges 51 of the partition member 50 as shown in FIG. 5. The partition member 50 is inserted such that the edges 51 engage with one of the pairs of slot features 64A, 64B or 64C, depending on the size of round that is placed in the container 10. For example, in FIG. 5, the partition member 50 is inserted into the slot features 64A. This divides the container into two compartments, 75A and 75B. For smaller caliber rounds, such as 5.56 mm or 7.62 mm rounds, a single belt can be placed in one of the compartments, folded in multiple layers extending along the length of the containers, or the single belt can be placed into both compartments 75A and 75B, by folding the belt in layers in one of the compartments (e.g., 75A), and then looping the belt over the partition member 50 with a twist and layering the belt in the other compartment 75B. The transverse partition 56A and 56B (FIG. 8) prevents undue sagging of the belt in the middle and allows more rounds to be stored.

With reference to FIGS. 5, 6 and 8, the bottom wall 76 of the container 10 includes a transverse member 63 which includes apertures 65. The two transverse partitions 56A and 56B includes tabs 61 which are placed into the apertures 64; to help position the transverse partitions 56A and 56B securely within the container. The transverse partitions 56A and 56B are omitted from the FIG. 5 view in order to illustrate the transverse member 63 on the floor of the container, but are shown in position in FIG. 8. The pin 30 extends through the tubular structure 58 in the transverse partitions 56 and through an opening 52 in the main partition member 50 (FIG. 7) to secure the transverse partitions to the container.

When the gunner wants to change ammunition to a larger caliber round (say, .50 cal. or 40 mm grenades), the gunner removes the old ammunition from the container, removes the pin 30, places the transverse partitions 56A and 56B into the holding space 66 (FIG. 5), lifts the main partition member 50 from the container and then inserts it into either the pair of slots 64B or 64C, depending on the size of the new rounds. The pin 30 is then reinserted into and through the container and the partition at the lower elevation 40B (see FIGS. 3 and 9). The pairs of slots 64B are positioned a distance from the wall 22C such that a belt containing 40 mm ammunition fits between the partition member 50 and the wall 22C. The pairs of slots 64C are positioned a distance from the wall 22C such that a belt containing .50 cal. ammunition fits between the partition member 50 and the wall 22C. FIG. 9 shows the configuration of the ammunition container with the partition member 50 engaged with the slots 64C. The pin 30 passes through the walls 22A and 22C of the container and through the lower aperture 54 in the partition member 50 (see FIG. 7).

As best shown in FIG. 10, when the larger ammunition is placed in the ammunition container 10, the lid 14 of FIG. 1 is removed, revealing an opening 80. The belts containing the larger ammunition are supplied via the opening 80 to the gun. The flap 18 is closed and the feed roller 82 is not used.

When smaller ammunition such as 5.56 mm or 7.62 mm rounds are placed in the ammunition container (container in the configuration of FIG. 8), the lid 14 is placed over the aperture (see FIG. 11) and the flap 18 is lifted up. The belt containing the smaller ammunition is fed over roller 82 and out the aperture 20 (see FIG. 1), where the belt is supplied to a feed chute (not shown) supplying the belt to the gun.

It will be appreciated from FIGS. 5 and 8 that at least three different sizes of ammunition can be stored properly in the container 10, depending on whether the partition is engaged in the pairs of slots 64A, 64B or 64C. When the partition 50 is placed in slots 64A, the difference is size between the 5.56 and 7.62 rounds is sufficiently small such that an ammunition belt with either size rounds can be placed on either or both sides of the partition member 50, so in effect the container adapts to contain ammunition of four different calibers (5.56 mm, 7.62 mm., .50 cal., and 40 mm.). In the configuration of FIGS. 5 and 8, if ammunition is placed on both sides of the partition, the container can contain approximately 2000 rounds of 7.62 mm ammunition and 3200 rounds of 5.56 mm ammunition.

From the foregoing, it will be appreciated that we have described an ammunition container 10 comprising an enclosure for holding a supply of ammunition (preferably in belt form) and having a partition member 50 positioned in the enclosure; and first, second and third holding features 64A, 64B and 64C positioned in a spaced apart relation relative to the enclosure adapted to engage the partition 50. The holding features 64A, 64B and 64C and partition 50 thereby providing a capability of holding ammunition of at least three different calibers, a first caliber (e.g., 5.56 mm or 7.62 mm) held in the container 10 when the partition 50 is engaged in the first holding feature 64A, a second caliber (40 mm) held in the container when the partition 50 is engaged in the second holding feature 64B, and a third caliber (.50 cal.) held in the container 10 when the partition 50 is engaged in the third holding feature 64C.

While a number of exemplary aspects and embodiments have been discussed above, those of skill in the art will recognize certain modifications, permutations, additions and sub-combinations thereof. For example, while the holding feature shown in the drawings takes the form of slots for receiving the edge of the partition member 50, other holding features can be developed by persons skilled in the art. It is therefore intended that the following appended claims and claims hereafter introduced are interpreted to include all such modifications, permutations, additions and sub-combinations as are within their true spirit and scope.

We claim:

1. An ammunition container, comprising:

an elongate rectangular enclosure for stowing a supply of ammunition having parallel opposed side walls defining a longitudinal direction of the enclosure and parallel opposed end walls;

a single partition member positioned in the enclosure in a manner parallel to the side walls and oriented in the longitudinal direction and extending substantially the entire length of the enclosure between the parallel opposed end walls;

first, second and third holding features in the enclosure positioned in a spaced apart relation adapted to engage the partition and to vary the width of the enclosure to first, second and third widths, respectively, the holding features and partition arranged to provide for stowing ammunition of at least three different calibers, a first caliber stowed in the container when the partition is engaged in the first holding feature, a second caliber stowed in the container when the partition is engaged in the second feature, and a third caliber stowed in the container when the partition is engaged in the third holding feature.

2. The ammunition container of claim 1, wherein when the partition is engaged with the first holding feature the container provides a feature for stowing ammunition of a fourth caliber, the fourth caliber and the first caliber both being sized such that a belt of ammunition of either the first or fourth caliber is stowed in the container between the partition and one of the side walls of the enclosure.

3. The ammunition container of claim 1, wherein the partition and the first holding feature are constructed and arranged such that when the partition is in the first holding feature the container is divided into two compartments, each capable of stowing a belt containing ammunition of the first caliber.

4. The ammunition container of claim 1, further comprising a transverse partition extending in a substantially transverse direction to the longitudinal orientation of the partition for supporting multiple layers of ammunition belts of ammunition of the first caliber.

5. The ammunition container of claim 4, wherein the container further comprises a region adapted for storing the transverse partition when the partition is engaged with the second or third pair of holding features.

6. The ammunition container of claim 4, further comprising a removable pin for securing the transverse partition to the ammunition container.

7. The ammunition container of claim 1, further comprising a single cover for the ammunition container, the cover comprising: 1) an integrated feed mechanism facilitating feeding of ammunition of the first caliber from the container; 2) an aperture formed in the cover providing an opening for feeding ammunition of the second or third caliber from the container to a weapon, and 3) a lid for the aperture.

8. The ammunition container of claim 1, further comprising attachment means for attaching the ammunition container to a weapon mount.

9. The ammunition container of claim 1, wherein the ammunition container comprises an ammunition container adapted with features to attaching the container to a remotely operated weapon mount.

10. The ammunition container of claim 9, wherein the remotely operated weapon mount further comprises a stabilized mount.

11. The ammunition container of claim 1, wherein the first, second and third holding features comprise first, second and third pairs of slots.

12. The ammunition container of claim 1, further comprising a region within the container adapted for storing a removable transverse partition, the removable transverse partition for supporting multiple layers of belts of ammunition of the first caliber.

13. Gunnery apparatus, comprising, in combination:

a remotely operated weapon mount, and an ammunition container adapted for supplying ammunition to guns mounted to the remotely operated weapon mount, comprising:

an elongate rectangular enclosure for stowing a supply of ammunition having parallel opposed side walls defining a longitudinal direction of the enclosure and parallel opposed end walls;

a single partition member positioned in the enclosure in a manner parallel to the side walls and oriented in the longitudinal direction and extending substantially the entire length of the enclosure between the parallel opposed end walls;

first, second and third holding features positioned in a spaced apart relation relative to the enclosure adapted to engage the partition and to vary the width of the enclosure to first, second and third widths, respectively, the holding features and partition thereby providing a capability of stowing ammunition of at least three different calibers, a first caliber stowed in the container when the partition is engaged in the first holding feature, a second caliber stowed in the container when the partition is engaged in the second feature, and a third caliber stowed in the container when the partition is engaged in the third holding feature.

14. The apparatus of claim 13, further comprising a single cover for the ammunition container, the cover comprising: 1) an integrated feed mechanism facilitating feeding of ammunition of the first caliber from the container; 2) an aperture formed in the cover providing an opening for feeding ammunition of the second or third caliber from the container, and 3) a lid for the aperture.

15. The apparatus of claim 13, wherein the partition comprises a flat plate and wherein the holding features comprises pairs of slots.

16. The apparatus of claim 13, further comprising a transverse partition extending in a transverse direction to the orientation of the partition.

17. The apparatus of claim 13, wherein the first caliber comprises either 5.56 mm or 7.62 mm rounds, the second caliber comprises 40 mm rounds, and wherein the third caliber comprises .50 caliber rounds.

18. A method of reconfiguring an ammunition container having a region for stowing ammunition of a first caliber, a second caliber and a third caliber, parallel opposed first and second side walls defining a longitudinal direction of the container and parallel opposed end walls, comprising the steps of:

positioning a single partition longitudinally within the region of the ammunition container for receiving ammunition, the partition placed in a first position wherein the ammunition of the first caliber is stowed between the partition and the first side wall of the container;

positioning the partition within the region in a second position relative to the container when ammunition of the second caliber is to be stowed in the region, the ammunition of the second caliber stowed between the partition and the first side wall of the container; and positioning the partition within the region in a third position when ammunition of the third caliber is to be stowed in the region, the ammunition of the third caliber stowed between the partition and the first side wall of the container; and wherein in the first, second and third positions the partition extends substantially the entire length of the container between the opposed end walls and varies the width of the container to first, second and third widths.

19. The method of claim 18, wherein the ammunition includes ammunition of a fourth caliber, and when the partition is positioned in the first position the method further includes the step of stowing ammunition of either the first or the fourth caliber between the partition and the first side wall of the container.

20. The method of claim 18, wherein when the partition is positioned in the first position the method further comprises the step of placing the ammunition of the first caliber within the container on both sides of the partition, namely between the partition and the first side wall and between the partition and the second side wall of the container opposite of the first side wall.

21. The method of claim 18, further comprising the steps of placing a transverse partition in the container such that the transverse partition supports multiple layers of a belt containing the ammunition of the first caliber when the belt containing ammunition of the first caliber is stowed between the partition and the first side wall; and removing the transverse partition when ammunition of the second caliber or the third caliber is stowed in the container.

22. The method of claim 21, further comprising the steps of stowing the transverse partition within the container after the step of removing is performed.

23. The method of claim 21, further comprising the steps of attaching a cover to the container and maintaining the cover in place while ammunition is fed from the container to an associated gun, the cover having an opening allowing ammunition to be withdrawn from the container and supplied to the gun.

24. The method of claim 18, further comprising the steps of attaching a cover to the ammunition container, the cover having an aperture and a removable lid covering the aperture, and removing the removable lid when the ammunition of the second caliber or the third caliber is stowed in the container.

* * * * *